United States Patent [19]

Martin et al.

[11] 4,314,541

[45] Feb. 9, 1982

[54] GRATE BAR FOR GRATE LININGS, ESPECIALLY IN FURNACES

[75] Inventors: Johannes J. Martin; Walter J. Martin, both of Munich, Fed. Rep. of Germany

[73] Assignee: Firma Josef Martin Feuerungsbau GmbH, Munich, Fed. Rep. of Germany

[21] Appl. No.: 12,077

[22] Filed: Feb. 14, 1979

[30] Foreign Application Priority Data

Feb. 18, 1978 [DE] Fed. Rep. of Germany ..... 2806974

[51] Int. Cl.[3] ..... F23H 11/00

[52] U.S. Cl. ..... 126/163 R; 110/281; 110/288; 126/167

[58] Field of Search ..... 126/163 R, 163 A, 167; 110/270, 281, 288, 267

[56] References Cited

U.S. PATENT DOCUMENTS

| | | | |
|---|---|---|---|
| 6,799 | 10/1849 | Kingsland | 126/167 |
| 1,481,366 | 1/1924 | Herkenrath | 126/167 |
| 1,822,034 | 9/1931 | Jessen | 126/167 |
| 4,103,627 | 8/1978 | Mainka | 110/281 |

FOREIGN PATENT DOCUMENTS

| | | | |
|---|---|---|---|
| 911317 | 4/1954 | Fed. Rep. of Germany | 110/281 |
| 959212 | 2/1957 | Fed. Rep. of Germany . | |
| 18273 | of 1907 | United Kingdom | 126/167 |
| 264334 | 1/1927 | United Kingdom | 126/167 |
| 278172 | 10/1927 | United Kingdom | 126/167 |
| 348904 | 5/1931 | United Kingdom | 110/281 |

*Primary Examiner*—Stephen P. Garbe

*Attorney, Agent, or Firm*—Oblon, Fisher, Spivak, McClelland & Maier

[57] ABSTRACT

A grate bar for a furnace grate lining is disclosed. The grate exhibits lateral contact surfaces and external ribs on its lower side in the vicinity of the contact surfaces. At least one jet-like air channel is in part formed by a recess in at least one lateral contact surface between adjoining grate bars.

9 Claims, 10 Drawing Figures

II
III
2
3
3'
3''
4
5
5'
6
7
7'
8
9
10
11
12
13
14
15
16
17
18
19
20
21
22
23
24
25
26
27
36

V
VI
18
9
4
8
11
33
32
30
12
31
13
10
28
14
36
3
7
21
25
29
6
5
26
5'
6'

FIG.7
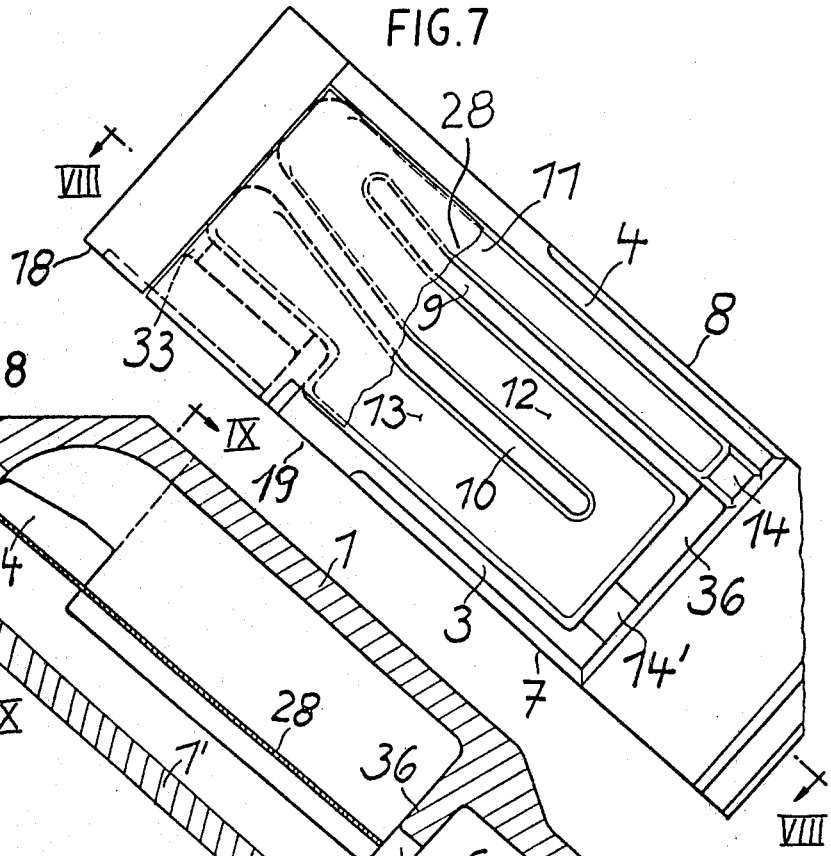
FIG.8
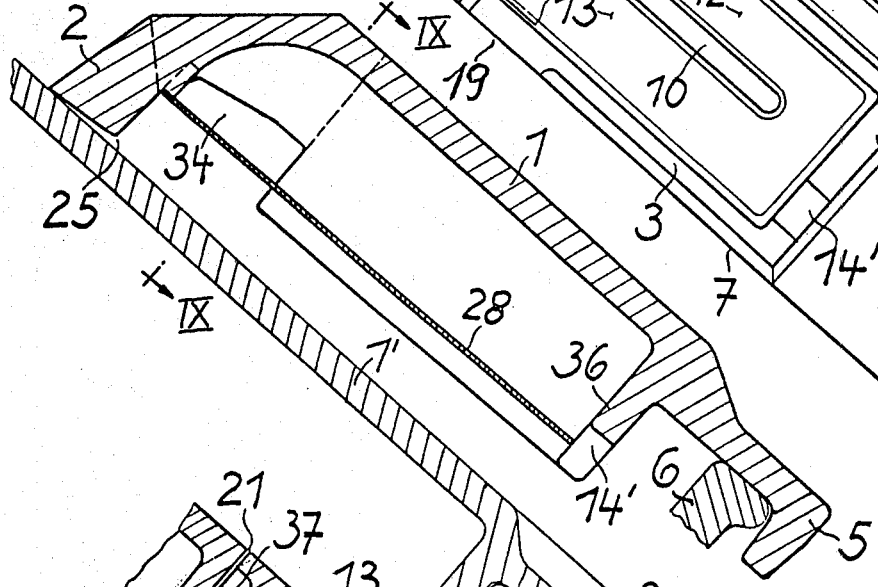
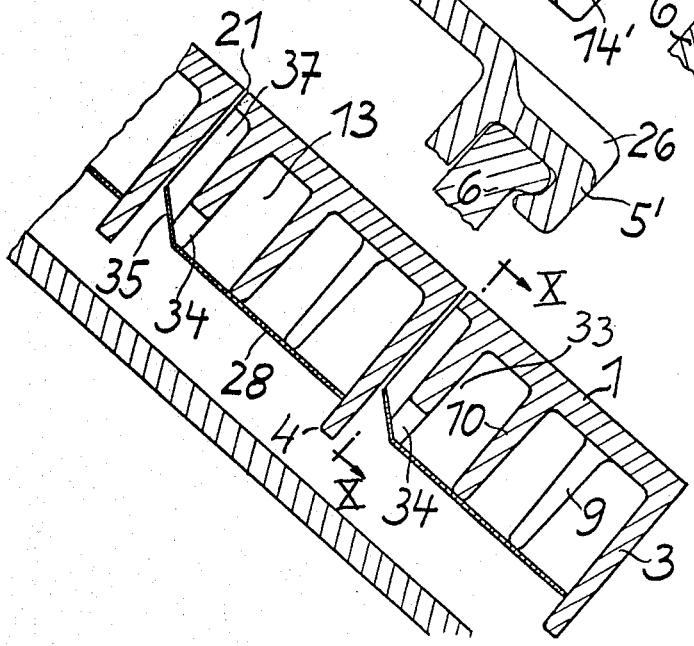
FIG.9

GRATE BAR FOR GRATE LININGS, ESPECIALLY IN FURNACES

BACKGROUND OF THE INVENTION

1. Field of the Invention

This invention involves a grate bar for grate linings, especially in furnaces, which exhibits lateral contact surfaces and external ribs.

2. Description of the Prior Art

In a known grate bar of this type (DE-PS No. 959212), the lateral contact surfaces are machined for reasons of sealing and friction reduction. These contact surfaces project above the external ribs along one part of the grate bar's length, so that only small surfaces need to be machined. The front of the bar contains a jet-like air channel which is formed by a recess in at least one lateral contact surface between adjoining bars. Air enters the burning layer situated above the grate lining through this air channel from the area beneath the grate after being forced through the grate bar.

Small particles from the burning layer may lodge in this air channel between adjoining external ribs of the grate bars, which are separated by a narrow interval. The intruding particles tend to separate the adjoining grate bars, causing the air supply forced through the hollow bars to be disturbed, since air can stream directly from the space beneath the grate into the combustion chamber between the resulting gap. This can lead to reduced air movement in the affected bars and consequently to overheating and increased wear. Such particles may also block the reciprocal travel of adjoining bars due to enlarged gaps, even if they do not cause wear despite the relative displacement of adjoining bars.

Since the lateral contact surfaces are subject to natural wear after extended operation, the space remaining under the air channel between the external ribs of adjoining bars gets progressively smaller, so that particles falling into the air channel remain suspended in this area and contribute to the operating faults described above.

The invention is designed to avoid the possibility of disturbances in the narrow space under the air channel due to jamming of particles escaping into the air channel, even when the lateral contact surfaces show increased wear; that is, it fashions the grate bar in such a manner that the particles entering the air channel are rapidly removed from the space beneath the air channel between the bars, even up increased wear of the contact surfaces, so that they are prevented from jamming between adjoining bars and from increasing the interval between adjoining bars. In particular, the hollow core cooling of the grate bar (in the case of bars with hollow cores) should not suffer undue interference.

SUMMARY OF THE INVENTION

The preceding task is solved by the present invention. The invention guarantees that sufficient space exists in the area of the air channel to accommodate penetrating particles while preventing wedging or jamming, even in the case of major wear of the lateral contact surfaces between the external ribs of adjoining grate bars. Even if wear of the lateral contact surfaces has progressed so far that the projection of the grate bar's ridge, when related to the external rib, is completely or almost completely worn, displacement of the external rib or withdrawal of the external rib in the area of the air channel produces sufficient space to prevent jamming of adjoining bars by intruding particles, even if they should accumulate in large numbers. Displacement of the external rib in the area of the air channel inward means that the path described by the intruding particle within the jet-like air channel, prior to reaching the wide passage chamber, is relatively short and limited to the thickness of the grate bar's ridge. This narrow air channel presents such a short pathway to the intruding particle, even in the region of the bar's end, that jamming is not anticipated, since these particles descend rapidly through the great width of the passage chamber. This rapid descent was not assured in connection with the known grate bar, since the space underneath the air channel was not much bigger than the air channel itself, so that the particles present in the space under the air channel prevented a follow-up by newly penetrating particles.

In accordance with the modifications of the invention, several provisions are made for uncomplicated removal of particles entering the passage chamber. One possibility is to let the descending particles rest on the ridge of the bar situated underneath in the grate lining, from where they can move by gravity toward the installed end of the bar and onto the bar's depression, or they may be pushed by the inner edge of the bar's head up to this depression, depending on the installation.

In another version, the particles penetrating to the passage chamber reach an intermediate chute equipped with an opening through which they attain the ridge of the bar situated underneath, and from there move to the space under the grate in the manner described above.

Finally, a modification is possible in which the intermediate chute serves as a transfer slide which leads the particles falling into the passage chamber and into the interior of the grate bar; i.e., into the air channel, in which the particles reach the back end of the bar due to the tilted installation, where they enter the recess of the bar situated below through an opening in a rear transverse rib which forms the wall of the hollow core of the bar, and finally reach the lower space under the grate.

The invention is also applicable to grate linings of mechanically activated stoking grates of large furnaces with staged grates consisting of individual grate bars which are joined by lateral contact surfaces projecting at least in part beyond the down-pointed external ribs of the grate bar and which limit the jet-like air channel occuping part of the bar's length. The air channel is formed by a recess in at least one lateral limiting surface. This grate lining is characterized essentially by at least one external rib in the area of the air channel projects in the direction of the bar's interior as opposed to the continued direction of this external rib, and thus, together with the external rib of the adjoining grate bar, forms a passage chamber for the particles entering the air channel.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

FIG. 7 is a view of a third version of a grate bar from below;

FIG. 8 is a mirror image of a sectional view taken along the line VIII—VIII in FIG. 7;

FIG. 9 is a section along the line IX—IX in FIG. 8, including adjoining grate bars.

DETAILED DESCRIPTION OF THE PREFERRED EMBODIMENTS

Figures 1, 2, 3:
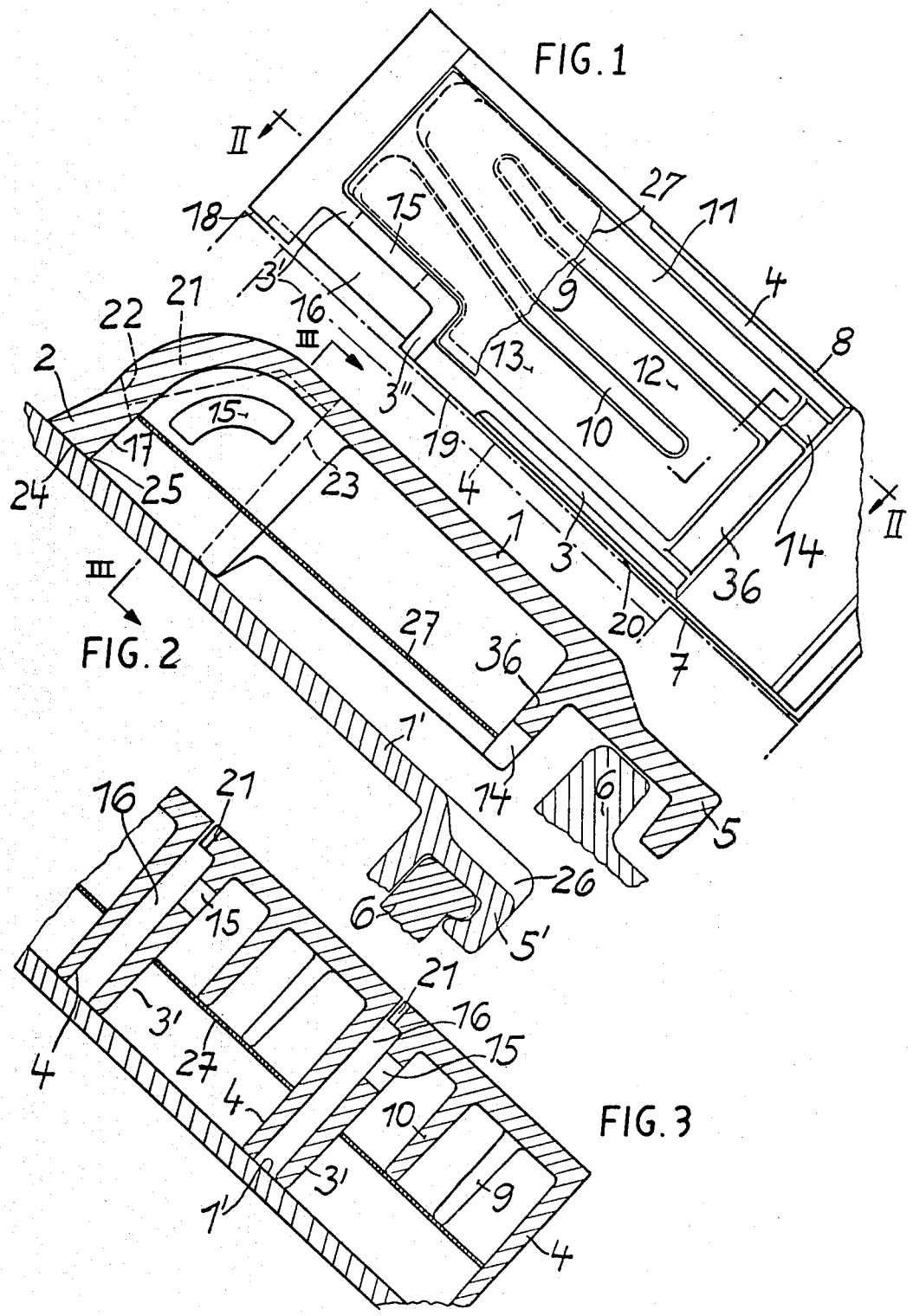
FIG. 1 is a view of the front part of a grate bar from below.
FIG. 2 is a mirror image of a sectional view taken along the line II—II in FIG. 1.
FIG. 3 is a section through the grate bar along the line III—III in FIG. 2, including a section of adjoining bars within a grate lining.

As evident from the Figures, all grate bars have substantially identical construction and incorporate a closed grate bar ridge 1, a grate bar head 2, which forms one end of the grate bar and is thicker when compared to the ridge, external ribs 3 and 4, and a suspension end 5 opposite the bar head, the suspension end is placed on a suspension rail 6 of a carrier frame (not depicted). Depending on the involvement of permanently fixed or travelling grate bars, the suspension end 5 is hooked to the suspension rail 6 either solidly or with limited longitudinal play. In the case illustrated, the grate bars form a grate lining consisting of individual, overlapping grate stages, with relative reciprocal movement where solid and movable bars alternate.

The external ribs 3 and 4 are slightly turned inward with respect to the lateral contact surfaces 7 and 8 of the grate bar ridge, with the exception of the forward area belonging to the bar head. This displacement is necessary to keep the lateral contact surfaces 7 and 8, which are to be machined for reasons of sealing and friction reduction, as small as possible. As the drawing shows, the hollow space limited by the external ribs 3 and 4 and by the bar head 2 and the transverse rib 36 provided in the area of the suspension end 5, can be divided into individual air channels 11, 12 and 13 by interior ribs 9 and 10. Air would enter these channels through an opening 14 provided in the suspension end 5, would move through each channel in turn, and would exit through an overflow opening 15 provided in the external rib 3 in the region of the bar head.

The external rib 3 proceeds inward along a certain length of the area belonging to the bar head and forms a limiting wall 3' of a passage chamber 16, which in the versions shown in FIGS. 1 through 3 is limited on either side by the forward section 3' of the external rib 3 and by an external rib 4 of the adjoining grate bar, on its front by the inner wall 17 of the bar head 2 and at its rear by an internally arranged connecting piece 3'' of the external rib 3. The closure to the front and back is preferably made by the machined contact surfaces 18 of the adjoining grate bar heads and by a similar contact surface 19 which joins the connecting area 3' in the direction of the suspension end 5 and is formed at a thickened part of the external rib 3. The contact surface 19 forms a pressure equalization barrier between the passage chamber 16, which accepts the air from the air channels through the overflow opening 15, and the space under the grate which communicates with the space 20 formed between the external ribs 3 of adjoining bars. The passage chamber 16 is sealed against the space below the grate by the intervening grate bar which is touched by the contact surfaces 18 and 19.

Contact surface 18 and lateral contact surface 7 of the grate bar are recessed in the proximity of the passage chamber 16, which produces an air channel 21 of desired form between adjoining grate bars. The air channel's forward and rear limitations are marked 22 and 23.

The air entering the passage chamber 16 flows from the air channel 21 into the burning layer above. It is possible, however, that solid particles from the burning layer reach the passage chamber 16 through the air channel 21. In the modification depicted in FIGS. 1 through 3, these particles settle on the grate bar ridge 1' of the grate bar which is situated below and forms the lower limit of the passage chamber 16. Falling particles are transported by the edge 25 formed by the rear limiting surface 17 of the grate bar head 2 and by the lower supporting surface 24 on the grate bar ridge 1' of the grate bar situated below during backward travel, and fall to the depression 26 at the suspended end 5' of the grate bar ridge 1' situated below, from which point they move to the space under the grate or to a funnel (not depicted).

Air channels 11 through 13, i.e., the entire hollow space between the external ribs 3 and 4 and between the grate bar head 2 and the transverse rib 36 is closed by a cover 27. The external ribs 3 and 4, as shown in FIG. 3, extend to the grate bar ridge 1' situated below, while internal ribs 9 and 10 only extend to the cover 27, which is located approximately one-third the distance from the lower side of the grate bar. Opening 14, which admits the flow of air into channels 11 to 13, is located in the transverse rib 36. If air channels are desired which are completely separated by the internal walls so that air passes through them in a parallel arrangement, then the transverse rib 36 should contain as many orifices as there are separate channels.

Cover 27 extends only across the area of the air channels 11 through 13, but does not extend into the passage chamber 16.

Figures 4, 5, 6:
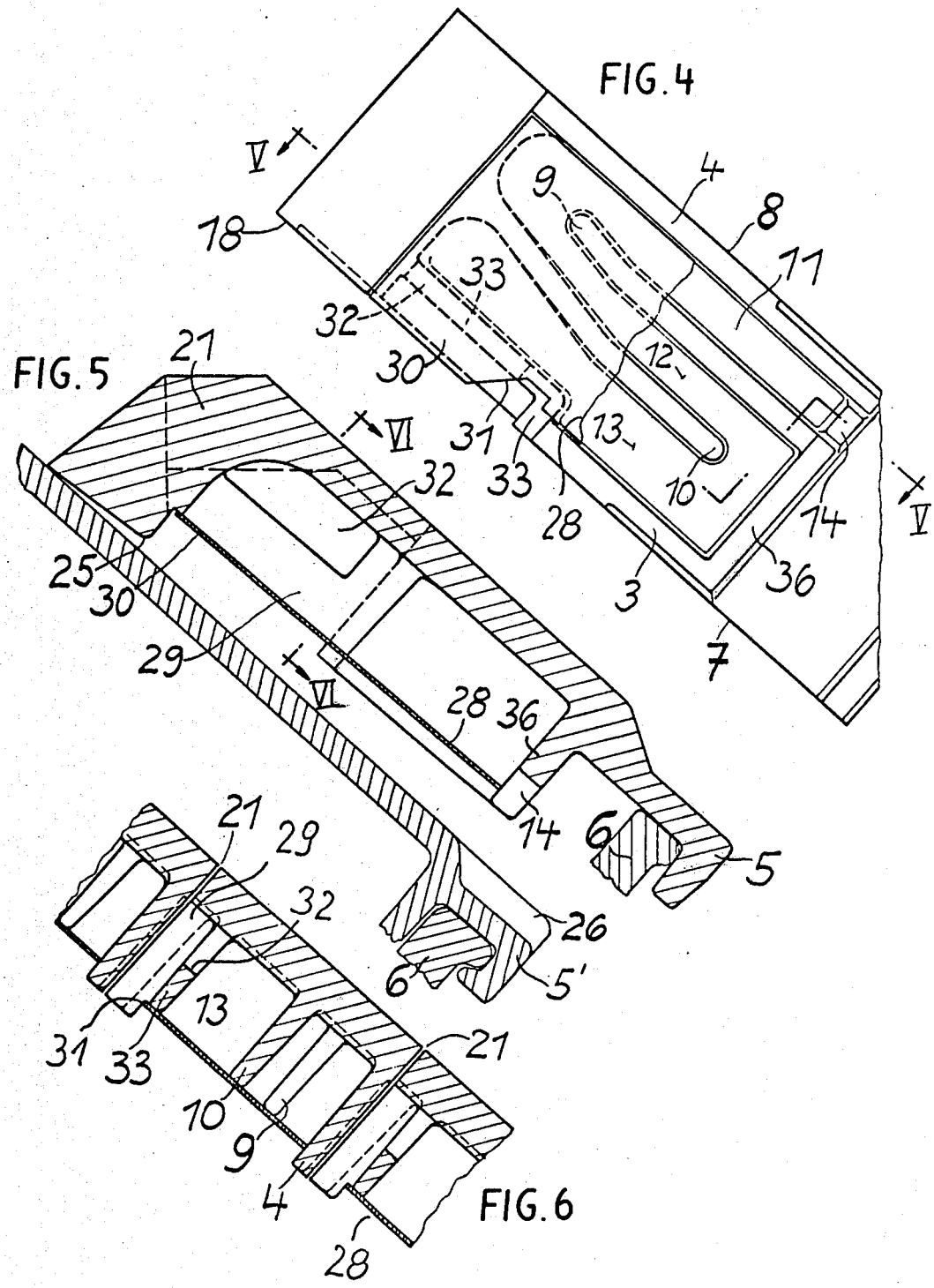
FIG. 4 is a view of a different embodiment of a grate bar from below.
FIG. 5 is a mirror of a sectional view taken along the line V—V in FIG. 4.
FIG. 6 is a section along the line VI—VI in FIG. 5, including a section of an adjoining grate bar.
Figure 10:
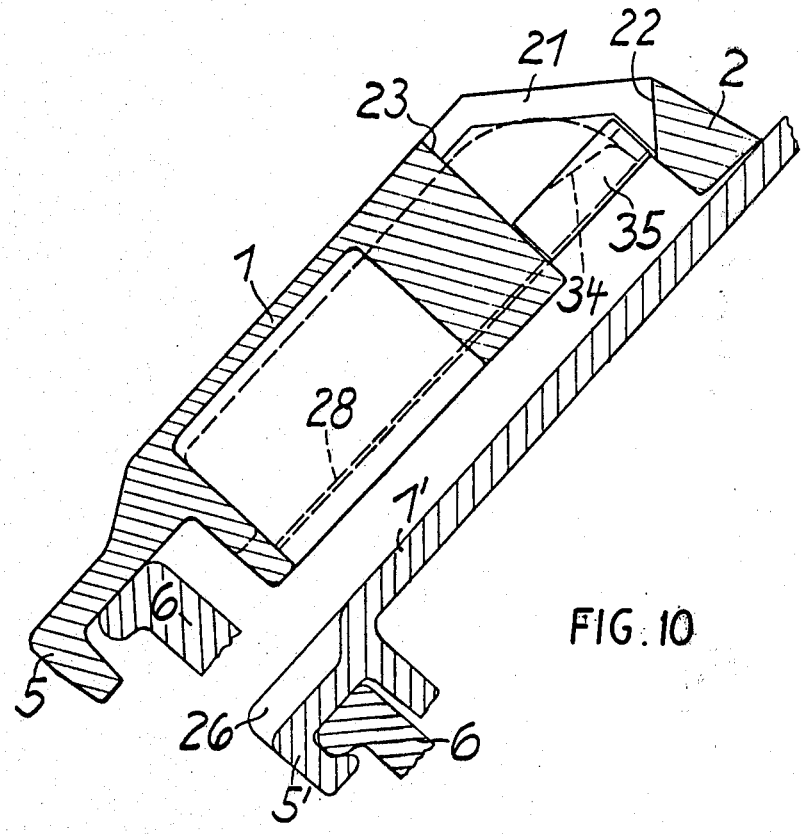
FIG. 10 is a view in the direction of the line X—X in FIG. 9.

In the version depicted in FIGS. 4 through 6, which incorporates a modification when compared to the embodiment in FIG. 1 through 3, all parts used identically in both versions are marked with the same numbers and for this reason are not described again.

In the modification shown in FIGS. 4 through 6, a cover 28 extends into the area of the passage chamber 29, which corresponds essentially to the passage chamber 16, but whose lower side does not extend as far as the grate bar situated below, and instead is limited by an intermediary bottom 30 which may be formed in one piece with the cover 28. This intermediary bottom 30 has an opening 31 through which particles entering from the air channel 21 and reaching the bottom 30 fall to the grate bar ridge below. From there, these particles move from the grate bar ridge in the same manner as described in connection with preceding versions. The intermediary bottom is provided to seal the passage chamber 29 against the space under the grate, since a lateral contact surface touching the grate bar situated below is not provided as in the version shown in FIGS. 1 through 3. FIG. 5 shows that the collection chamber 29 without an intermediary bottom 30 would be in constant communication with the space under the grate across a large flow diameter while the modification limits the opening 31 to a relatively small diameter.

The external rib 3, which limits the passage chamber 29 rearward, that is, in the direction of the suspension end, has an elevation (in the version depicted in FIGS. 4 through 6) which matches that of the internal ribs 9 and 10, so that the intermediary bottom 30 and the cover 28 can be made of one piece. Number 33 identifies that part of the external rib 3 which is located in the proximity of the passage chamber and is shortened in its elevation. This arrangement requires an intermediary bottom to prevent a permanent short circuit of the flow.

In the version illustrated in FIGS. 7 through 10, those parts which are identical in modifications depicted in FIGS. 1 through 6 are numbered as before. In this version, the areas of external rib 3 which limit the passage chamber 29 are similarly adjusted in height to be the same as the elevation of internal ribs 9 and 10. In contrast to the version shown in FIGS. 4 through 6, this part 33 of the external rib has the necessary overflow opening at the lower end of the external rib part 33 and is marked 34. This modification also requires a seal between the space under the grate and the passage chamber 29 to prevent a permanent short circuit of the flow due to the shortened external rib. This seal is provided by the intermediary bottom 35 in the proximity of the passage chamber 29, formed of one piece with the cover 28. In contrast to the embodiment seen in FIGS. 4 through 6, the intermediary bottom 35 is placed at an angle on its outer edge, so that it forms a transfer chute on which particles entering through the air channel 21 reach the overflow opening 34 and thence to the air channel 13, so that these particles slide within the grate bar toward the suspension end 5 due to the inclined installation, from which point they exit at the opening 14' and reach the grate bar ridge of the grate bar situated below. From there the particles are transported by the rear edge 25 of the grate bar head, unless they move to the depression 26 under the effects of gravity (due to the incline) and thence to the space below the grate.

In the modification shown in FIGS. 1 through 3, a short circuit in the flow sets in during stroke reversal between the lower side of the grate and the furnace at the time the connecting piece 3'' (which extends to the grate bar ridge) reaches the depression 26. In this case the passage chamber 16, which is open at the bottom, is connected with the lower side of the grate via the depression 26, so that part of the air bypasses the grate bar's interior and enters the furnace directly from the grate bottom through the air channel 21. This short circuit in the flow may be desirable in order to clear the air channel 21 with increased air pressure.

In the version depicted in FIGS. 4 through 6, part 33 of the external rib does not extend to the grate bar situated below, so that this part cannot form a seal toward the lower side of the grate. The seal is provided by the intermediary bottom 30. Due to the opening 31, a partial short circuit of the flow exists constantly between the lower side of the grate and the furnace via the air channel 21. About 25 percent of the air flowing through the grate lining passes through this bypass orifice, with respect to the air channels in the grate bar, while the remainder flows through the internal space of the grate bars.

Due to the sealing of the entire lower side of the passage chamber 37 by means of the intermediary bottom 35 in the modification shown in FIGS. 7 through 10, a short circuit in the flow between the lower side of the grate and the furnace cannot occur via the air channel 21 at any stage of operation.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. At least a first and second grate bar for a furnace grate lining, said second grate bar having an external rib, said first grate bar comprising:

a closed grate bar ridge;

a lateral contact surface connected to said ridge and adjoining said second grate bar;

at least one external rib downwardly extending from said ridge, a forward section only of said at least one external rib being staggered inwardly under said closed grate bar ridge and projecting inwardly toward an interior portion of said first grate bar; and a passage chamber defined by said interior projecting portion of said at least one external rib and said external rib of said second grate bar;

said passage chamber forming a portion of a jet-like air channel and accommodating sediment passing through said air channel.

2. The grate bars of claim 1, wherein said first grate bar includes an overflow orifice formed in said at least one external rib for the passage of air from the interior of said grate bar to said passage chamber.

3. The grate bars of claim 2, wherein said overflow orifice is provided in an upper region of said passage chamber.

4. The grate bars of claim 2, wherein said passage chamber is limited in extent toward a space under said first grate bar by an intermediary bottom portion which closes said overflow orifice with the lower edge and which serves as a transfer chute for the transport of said sediment from said passage chamber to said air channel of said first grate bar, from which said sediment moves to said space below said first grate bar through a second orifice.

5. The grate bars of claim 1 wherein said passage chamber is limited in extent toward a space under said grate by an intermediary bottom portion which includes an orifice for said sediment.

6. The grate bars of claim 4 or 5, said first grate bar further comprising a lower cover, wherein said intermediary bottom portion is formed as an extension of the lower cover of said first grate bar.

7. The grate bars of claim 4 wherein said intermediary bottom portion is inclined toward said overflow orifice.

8. The grate bars of claim 1 further comprising a third grate bar and means for reciprocating said first grate bar wherein said passage chamber is open toward said third grate bar and is sealed by said third grate bar during an entire cycle of the reciprocation of said first grate bar by said reciprocating means, with the exception of a stroke reversal phase, during which said passage chamber communicates with a depression situated underneath said first grate bar on a suspension end portion of said third grate bar.

9. The grate bars of claim 1, said grate lining being formed by first and second grate bars.

* * * * *

UNITED STATES PATENT AND TRADEMARK OFFICE

CERTIFICATE OF CORRECTION

PATENT NO. : 4,314,541

DATED : Feb. 9, 1982

INVENTOR(S) : Johannes J. Martin, et. al.

It is certified that error appears in the above—identified patent and that said Letters Patent is hereby corrected as shown below:

On The Title Page, Inventors Information to read as follows:

[75]---Inventors: Johannes J. Martin; Walter J. Martin; Erich Weber, all of Munich, Fed. Rep. of Germany Signed and Sealed this

*Sixth* Day of *July 1982*

[SEAL]

*Attest:*

GERALD J. MOSSINGHOFF

*Attesting Officer*

*Commissioner of Patents and Trademarks*